US006378353B1

(12) United States Patent
Wunderlich

(10) Patent No.: US 6,378,353 B1
(45) Date of Patent: Apr. 30, 2002

(54) ELECTROMECHANICAL DRIVE FOR METAL PART FORMING MACHINE

(75) Inventor: Horst Wunderlich, Neuenrade (DE)

(73) Assignee: W. Löttgers GmbH & Co. KG, Neuenrade (DE)

( * ) Notice: Subject to any disclaimer, the term of this patent is extended or adjusted under 35 U.S.C. 154(b) by 0 days.

(21) Appl. No.: 09/692,496

(22) Filed: Oct. 19, 2000

(30) Foreign Application Priority Data

Oct. 19, 1999 (DE) ..... 199 50 297

(51) Int. Cl.[7] ..... B21D 5/04
(52) U.S. Cl. ..... 72/389.4; 72/453.03; 72/454
(58) Field of Search ..... 72/453.01, 453.03, 72/389.3, 454, 386.4, 453.02

(56) References Cited

U.S. PATENT DOCUMENTS

| | | | | | |
|---|---|---|---|---|---|
| 3,686,922 | A | * | 8/1972 | Bley | 72/453.02 |
| 4,347,727 | A | * | 9/1982 | Galiger | 72/389.4 |
| 4,920,783 | A | * | 5/1990 | Greaves et al. | 72/454 |
| 4,956,992 | A | * | 9/1990 | Undin | 72/453.01 |
| 4,959,989 | A | * | 10/1990 | Obrecht et al. | 72/453.03 |
| 5,092,151 | A | * | 3/1992 | Catti et al. | 72/389.4 |
| 5,195,354 | A | * | 3/1993 | Yasui et al. | 72/453.03 |

FOREIGN PATENT DOCUMENTS

| | | |
|---|---|---|
| DE | 2149068 | 4/1973 |
| DE | 3537085 | 4/1987 |

OTHER PUBLICATIONS

Huber, "Flexible Automatisierung Mit Digital Gesteuerten Elektro–Hydraulischen Servoantrieben," An Triebstechnik Apr. 91, pp. 92, 97, 98.

"Home Flexibilität Bei Minimierten Rüstzeiten", Industrieanzeiger, Jan. 2, 1996, pp. 24–25.

* cited by examiner

*Primary Examiner*—David Jones
(74) *Attorney, Agent, or Firm*—Flanagan & Flanagan; John R. Flanagan

(57) ABSTRACT

A hydromechanical drive for a metal part forming machine includes an electric motor having a rotary output shaft, a drive shaft attached to the rotary output shaft and adapted to undergo rotational motion therewith about a rotational axis defined by the drive shaft, and a motion conversion mechanism coupled with the drive shaft and being movable between expanded and retracted positions along the drive shaft in response to the rotational movement of the drive shaft. The motion conversion mechanism has a first coupling element stationarily disposed at a fixed location offset from one side of the drive shaft and a second coupling element movably disposed at another location offset from another side of the drive shaft being angularly displaced from the one side thereof. The second coupling element is interconnected with a piston of a hydraulic transmitter of the forming machine such that movement of the motion conversion mechanism between the expanded and retracted positions along the drive shaft in response to rotation of the drive shaft about the rotational axis causes movement of the second coupling element toward and away from the fixed first coupling element and movement therewith of the remainder of the motion conversion mechanism, except for the fixed first coupling element, as well as movement of electric motor, drive shaft and the piston of the hydraulic transmitter connected to the second coupling element along a generally linear reciprocatory path extending in a generally orthogonal relationship to the rotational axis of the drive shaft.

14 Claims, 2 Drawing Sheets

ELECTROMECHANICAL DRIVE FOR METAL PART FORMING MACHINE

BACKGROUND OF THE INVENTION

1. Field of the Invention

The present invention relates to machines for forming metal parts, such as by bending, punching and/or swaging the parts, and, more particularly, is concerned with an electromechanical drive for a hydraulically translating drive system of such metal part forming machines.

2. Description of the Prior Art

Machines for forming metal parts are known which have a vertically disposed workbench on which tools which operate sequentially or in parallel are disposed on a sliding carriage so as to be movable therewith. The tools can be operated to bend metal parts appropriately introduced at several sites in different planes as well as at different angles.

To slidably move each sliding carriage and tool therewith, a hydraulic translating driving system is provided in the machine which includes a hydraulic cylinder-like transmitter and a hydraulic cylinder slidably moving the sliding carriage. The hydraulic transmitter and the hydraulic cylinder are connected in a closed circuit via a line conveying hydraulic fluid between them. The hydraulic cylinder includes a cylinder housing and a working piston therein which slides the carriage and the tool therewith. The hydraulic transmitter also includes a piston which, for purposes of generating pressure, is slidable via a cam disk seated on a common driving shaft of the machine on which other cam disks are disposed for driving other systems of the machine operating in parallel. The driving shaft is driven via a common electric drive, for example a stepping motor, of the machine.

In order to reset the working piston of the hydraulic cylinder from its operating position, it is connected with a pressure storage system, for example a pressure line system, which functions against a nitrogen bladder in a container for pressure storage. If the corresponding hydraulic transmitter is set to be pressureless, the working piston of the pressurized hydraulic cylinder is moved back again via the pressure storage medium and therein takes back the carriage and the bending tool on the workbench therewith.

In machines of this type only small quantities of oil or hydraulic fluid are moved in their working systems operating separately from one another. For that reason, high operating speeds can be attained.

However, a disadvantage which has been found in such machines is the relatively high imprecision of the cam disk control which, due to the hydraulic translation, exerts a strong effect on the precision of the working steps of the tools. For increasing the precision of the operating steps of such machines with several tools on one workbench, it is known to use so-called linear amplifiers operating as individual drives, in which an NC valve is combined with the hydraulic cylinder in one structural unit. However, in such machines no hydraulic translation takes place. The hydraulic pressure is provided via a central hydraulic supply which under electronic control supplies jointly several such linear amplifiers. The linear amplifiers operate with stepping motors and ball spindles via which the working cylinder can be moved into its starting working position or be retracted from it. In such working position the pressure is applied onto the working position under control via the central hydraulic supply. Such devices have the disadvantage that via the central hydraulic supply relatively large quantities of oil must be transported which, by necessity, leads to a slowing of the operating speed. Linear amplifiers for the described application purpose are known from the publication HUBER, H.-J.: Flexible Automatisierung, nit digital gesteuerten electrohydraulischen Servoantrieben, in: *VDI-Z, Spezial* Apr. 1, 1991 Antriebstechnik, pp. 92, 97–98.

Consequently, a need exists for an innovation which will overcome the aforementioned disadvantages without introducing other disadvantages in place thereof.

SUMMARY OF THE INVENTION

The present invention overcomes the aforementioned disadvantages by providing an electromechanical drive for a metal part forming machine. The electromechanical drive increases the mechanical control and working precision of a hydraulically translating drive system of the metal part forming machine with the additional capability of increasing the operating speed of the machine.

Accordingly, the present invention is directed to an electromechanical drive for a metal part forming machine. The electromechanical drive includes a source of rotary drive motion such as an electric motor having a rotary output shaft, a drive shaft attached to the rotary output shaft and adapted to undergo rotational motion therewith about a rotational axis defined by the drive shaft, and a motion conversion mechanism coupled with the drive shaft and being movable between expanded and retracted positions along the drive shaft in response to the rotational movement of the drive shaft. The motion conversion mechanism has a first coupling element stationarily disposed at a fixed location offset from one side of the drive shaft and a second coupling element movably disposed at another location offset from another side of the drive shaft angularly displaced from the one side thereof for connecting with an external mechanism such that movement of the motion conversion mechanism between the expanded and retracted positions along the drive shaft in response to rotation of the drive shaft about the rotational axis causes movement of the second coupling element toward and away from the another side of the drive shaft and thus movement of the remainder of the motion conversion mechanism except for the fixed first coupling element, and movement of the source of rotary drive motion, the drive shaft and the external mechanism connected to the second coupling element therewith along a generally linear reciprocatory path extending in a generally orthogonal relationship to the rotational axis of the drive shaft.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
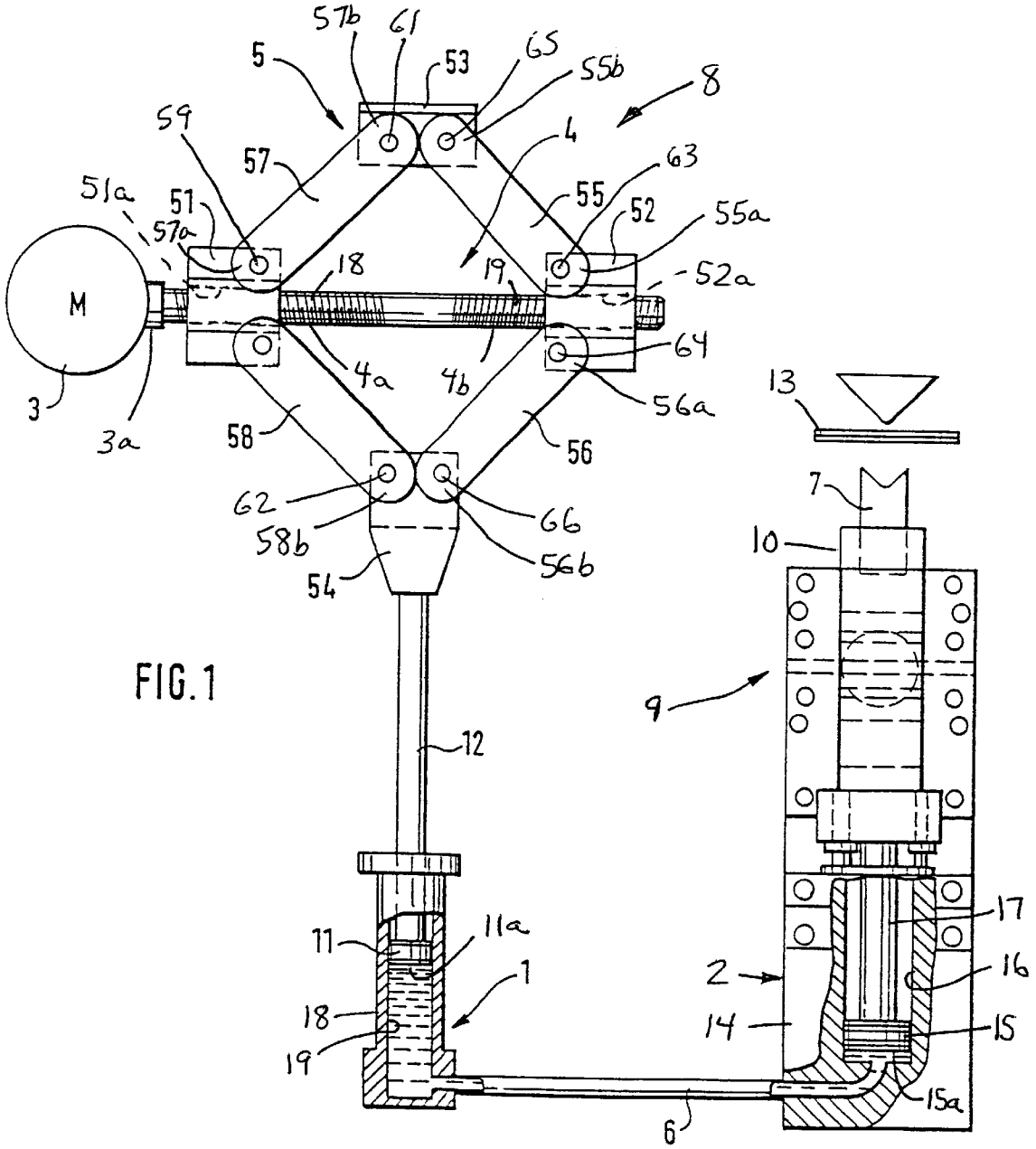
FIG. 1 is a diagrammatic representation of a metal part forming machine having an electromechanical drive of the present invention being shown disposed in an expanded position in which a tool of the machine is placed in an initial position at the start of a working process of the machine.
Figure 2:
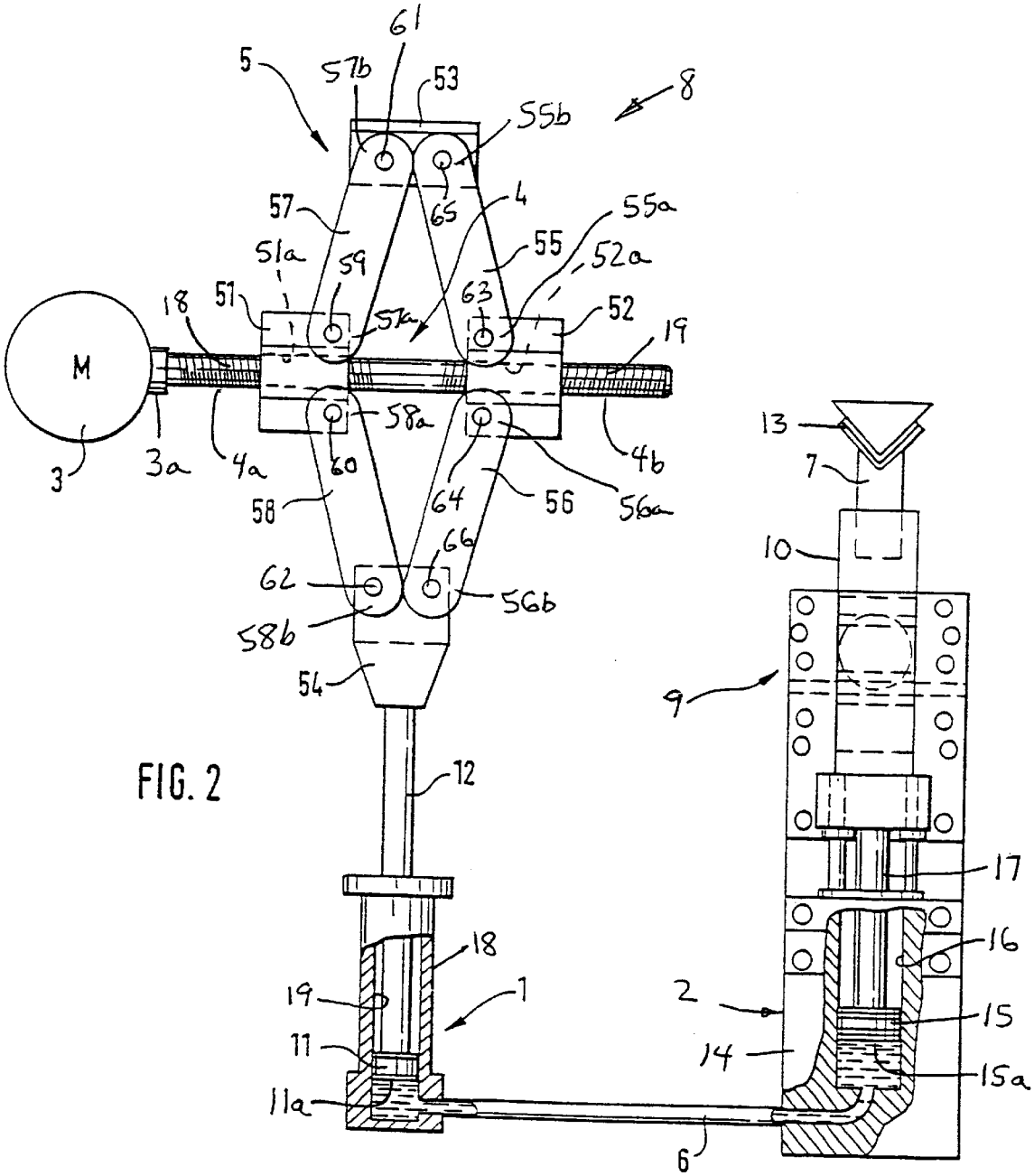
FIG. 2 is a diagrammatic representation similar to that of FIG. 1 now showing the electromechanical drive disposed in a retracted position in which the tool is placed in a final position at the completion of the working process of the machine.

Referring to the drawings and particularly to FIGS. 1 and 2, there is schematically illustrated an electromechanical drive of the present invention, generally designated 8, employed in a prior art metal part forming machine which includes a hydraulic cylinder-like transmitter 1 and a hydraulic cylinder 2. The machine also includes a machinery table 9 with the hydraulic cylinder 2 attached thereto and disposed therebelow. The machinery table 9 slidably supports a sliding carriage 10 and the hydraulic cylinder 2 is operable to slidably move the sliding carriage 10 along a generally linear reciprocatory path. The sliding carriage 10, in turn, supports a bending tool 7 for undergoing movement with the carriage 10 toward and away from a metal part 13 disposed thereabove. Specifically, the hydraulic cylinder 2 includes a housing 14 and a working piston 15 disposed in a bore 16 of the housing 14. The working piston 15 is connected to a lower end of a piston rod 17 which, in turn, is connected to the lower end of the carriage 10. Movement of the working piston 15 along the linear reciprocatory path extending between opposite ends of the housing 14 causes sliding of the carriage 10 and the tool 7 therewith relative to the housing 14 along the linear reciprocatory path.

The hydraulic transmitter 1 includes a tubular housing 18 and a piston 11 slidably movable in a cavity 19 of the housing 18 along a generally linear reciprocatory path extending between the opposite ends of the tubular housing 18. The piston 11 is fixedly mounted to a lower end of a piston rod 12 that extends from an upper end of the tubular housing 18. The piston rod 12 has an upper end coupled to the hydromechanical drive 8 of the present invention. The hydraulic cylinder 2 is interconnected to the hydraulic transmitter 1 via a closed circuit provided by a line 6 through which hydraulic fluid is conveyed between the cavity 19 of the hydraulic transmitter 1 and the bore 16 of the housing 14 of the hydraulic cylinder 2 and in contact with lower faces 11*a* and 15*a* of the respective pistons 11, 15.

The hydromechanical drive 8 includes a source of rotary drive motion preferably in the form of an electric stepping motor 3, a ball spindle drive shaft 4 attached to the motor 3, and a motion conversion mechanism 5 coupled with the drive shaft 4. The drive shaft 4 is fixedly attached to and extends outwardly from a driven end of a rotary output shaft 3*a* of the motor 3 so as to define a rotational axis which extends in generally orthogonal relationship to the aforementioned linear reciprocatory paths of the respective pistons 11, 15. The drive shaft 4 has left and right portions 4*a*, 4*b* which are axially displaced from one another and on which are formed respective left and right screw threads 18, 19.

The motion conversion mechanism 5 includes a pair of guidance blocks 51, 52, a pair of coupler elements 53, 54 and left and right pairs of upper and lower guide links 57, 58 and 55, 56. The guidance blocks 51, 52 are mounted over the drive shaft 4 and having internal threads 51*a*, 52*a* complementary to those of the left and right screw threads 18, 19 on the drive shaft 4 such that the guidance blocks 51, 52 respectively are threadably engaged with the left and right screw threads 18, 19 on the drive shaft 4. The upper coupling element 53 is fixedly connected to a stationary portion of the machine (not shown) at a location offset from one side of the drive shaft 4 such that the upper coupling element 53 remains at a fixed stationary position. The lower coupling element 54 is connected to the upper end of the piston rod 12 of the hydraulic transmitter 1 and movable therewith and is disposed at a location offset from another side of the drive shaft 4 being opposite from the one side thereof where the fixed upper coupling element 53 is located. The left pair of upper and lower guide links 57, 58 at their adjacent one ends 57*a*, 58*a* are pivotally articulated by pins 59, 60 to the left guidance block 51 and extend therefrom to opposite ends 57*b*, 58*b* located remote from one another which are pivotally articulated by pins 61, 62 respectively to the fixed coupler element 53 and movable coupler element 54. The right pair of upper and lower guide links 55, 56 at their adjacent one ends 55*a*, 56*a* are pivotally articulated by pins 63, 64 to the right guidance block 52 and extend therefrom to opposite ends 55*b*, 56*b* located remote from one another which are pivotally articulated by pins 65, 66 respectively to the fixed coupler element 53 and movable coupler element 54. The left and right screw threads 18, 19 have respective helical configurations which are the reverse of one another such that upon rotation of the drive shaft 4 in one direction by the motor 3 the guidance blocks 51, 52 will be translated along the drive shaft 4 away from one another to an initial expanded position depicted in FIG. 1, whereas upon rotation of the drive shaft 4 in an opposite direction by the motor 3 the guidance blocks 51, 52 will be translated along the drive shaft 4 toward one another to a final retracted position depicted in FIG. 2. The movements of the guidance blocks 51, 52 away from and toward one another between the expanded position of FIG. 1 and retracted position of FIG. 2 cause the opposite ends 57*b*, 58*b* and 55*b*, 56*b* of the respective upper and lower guide links of the left and right pairs thereof to correspondingly undergo relative movement toward and away from one another. In view that the corresponding opposite ends 57*b*, 55*b* of the upper guide links 57, 55 of the left and right pairs thereof are pivotally articulated to the upper stationarily-held or fixed coupler element 53, the corresponding opposite ends 58*b*, 56*b* of the lower guide links 58, 56 of the left and right pairs thereof and the motor 3 and drive shaft 4 are together moved in a downward direction in response to the guidance blocks 51, 52 being translated toward one another from the expanded position of FIG. 1 to the retracted position of FIG. 2 and are together moved in an upward direction in response to the guidance blocks 51, 52 being translated away from one another from the retracted position of FIG. 2 to the expanded position of FIG. 1. Due to the pivotal coupling of the guide links 58, 56 with the lower movable coupler element 54 and its attachment to the piston rod 12 of the hydraulic transmitter 1, such downward movement of the hydromechanical drive 8 causes the piston rod 12 and piston 11 of the hydraulic transmitter 1 to move downward which, in turn, forces hydraulic fluid to flow from the cavity 19 of the tubular housing 18 of the hydraulic transmitter 1 through the line 6 and into the bore 16 of the housing 14 of the hydraulic cylinder 2 which forces the working piston 15 and piston rod 17 to move upward and slidably lift the carriage 10 and tool 7 toward the metal part .13 from the initial position of FIG. 1 to the final position of FIG. 2 for completing or carrying out a bending process, for example. Conversely, upward movement of the hydromechanical drive 8 moves the piston rod 12 and piston 11 of the hydraulic transmitter 1 to move upward which, in turn, draws flow of hydraulic fluid from the bore 16 of the housing 14 of the hydraulic cylinder 2 through the line 6 and into the cavity 19 of the tubular housing 18 of the hydraulic transmitter 1 allowing the working piston 15 and piston rod and carriage 10 and tool 7 therewith to fall due to the force of gravity downward away from the metal part from the final position of FIG. 2 back to the initial position of FIG. 1 for returning to the starting position of the bending process. Not shown are other devices which are utilized in a known manner for guiding back the working piston 15 of the hydraulic cylinder 2 and thus of the sliding tool carriage 10 to their initial position.

From the above description, it can be readily understood that the hydromechanical drive 8 operates in the manner of a scissor-type jack for converting the rotary or circular motion of the electric motor 3 about the rotational axis defined by the drive shaft 4 into the reciprocatory motion of the guidance blocks 51, 52 toward and away from one another along the drive shaft 4 and then into reciprocatory pivotal motion of the left and right pairs of upper and lower guide links 57, 58 and 55, 56 about the respective pivot pins 59–66 and finally into the linear reciprocatory motions of the respective pistons 11, 15 of the hydraulic transmitter 1 and hydraulic cylinder 2. It should also be realized that, by using the hydromechanical drive 8 of the present invention, relatively small driving units for the individual tools can be attained, in which due to the direct driving of the piston 11 of the hydraulic transmitter 1 high operating precision can be obtained. The interconnection of the drive motion from the driving motor 3 to the piston 11 of the hydraulic transmitter 1 in combination with the hydraulic translation available in the hydraulic transmitter 1 lead to high translation ratios and thus to small driving units and a reduction of the size of the electric motors utilized. Due to the small quantities of the hydraulic fluid to be transported, the operating speed is thereby also increased.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A hydromechanical drive for a metal part forming machine, said hydromechanical drive comprising:

(a) a source of rotary drive motion;

(b) an elongated drive shaft attached to said source of rotary drive motion and adapted to be moved in a selected one of opposite rotational directions about a rotational axis defined by said drive shaft in response to said rotary drive motion of said source thereof; and (c) a motion conversion mechanism coupled with said drive shaft and being movable between expanded and retracted positions along said drive shaft in response to said rotational movement of said drive shaft, said motion conversion mechanism having a first coupler element stationarily disposed at a fixed location offset from one side of said drive shaft and a second coupler element movably disposed at another location offset from another side of said drive shaft angularly displaced from said one side thereof for connecting with an external mechanism such that movement of said motion conversion mechanism between said expanded and retracted positions along said drive shaft in response to rotation of said drive shaft about said rotational axis causes movement of said second coupler element toward and away from said another side of said drive shaft and movement of the remainder of said motion conversion mechanism, except for said fixed first coupler element, and movement of said source of rotary drive motion, said drive shaft and the external mechanism connected to said second coupler element therewith along a generally linear reciprocatory path extending in a generally orthogonal relationship to said rotational axis of said drive shaft.

2. The drive of claim 1 wherein said source of rotary drive motion is an electric motor having a rotary output shaft, said drive shaft being fixedly attached to and extending outwardly from said rotary output shaft of said electric motor.

3. The drive of claim 1 wherein said drive shaft has left and right portions which are axially displaced from one another and on which are formed respective left and right screw threads.

4. The drive of claim 3 wherein said motion conversion mechanism includes a pair of guidance blocks mounted over said drive shaft and having internal threads complementary to said left and right screw threads on said drive shaft such that said guidance blocks respectively are threadably engaged with said left and right screw threads on said drive shaft.

5. The drive of claim 4 wherein said motion conversion mechanism further includes a left pair of upper and lower guide links which at adjacent one ends thereof are pivotally articulated to said left guidance block and extend therefrom to opposite ends thereof being located remote from one another and pivotally articulated to said fixed first coupler element.

6. The drive of claim 5 wherein said motion conversion mechanism further includes a right pair of upper and lower guide links which at adjacent one ends thereof are pivotally articulated to said right guidance block and extend therefrom to opposite ends thereof being located remote from one another and pivotally articulated to said fixed first coupler element.

7. The drive of claim 6 wherein said left and right screw threads have respective helical configurations which are the reverse of one another such that in response to rotation of said drive shaft in one direction said guidance blocks will translate along said drive shaft away from one another, whereas in response to rotation of said drive shaft in an opposite direction said guidance blocks will translate along said drive shaft toward one another such that said translations of said guidance blocks away from and toward one another causes said left and right pairs of upper and lower links to correspondingly undergo relative movement toward and away from one another and said movable coupler element to undergo movement along said linear reciprocatory path so as to thereby convert said rotary motion of said source thereof and said drive shaft about said rotational axis into said linear reciprocatory motion of said movable coupler element in a direction orthogonal to said rotational axis.

8. A metal part forming machine, comprising:

(a) a hydraulic cylinder having a bore and a piston slidably movable in said bore to slidably move a carriage and a forming tool mounted thereon along a first linear reciprocatory path between initial and final positions of a forming process of said machine;

(b) a hydraulic transmitter having a cavity and a piston slidably movable in said cavity along a second linear reciprocatory path;

(c) a hydraulic circuit extending between and interconnecting said hydraulic transmitter and said hydraulic cylinder such at hydraulic fluid can be transmitted between said cavity of said hydraulic transmitter and said bore of said hydraulic cylinder and make contact with said respective pistons therein; and (d) a hydromechanical drive coupled to said piston of said hydraulic transmitter, said hydromechanical drive including (i) a source of rotary drive motion, (ii) an elongated drive shaft attached to said source of rotary drive motion and adapted to be moved in a selected one of opposite rotational directions about a rotational axis defined by said drive shaft in response to said rotary drive motion of said source thereof, and (iii) a motion conversion mechanism coupled with said drive shaft and being movable between expanded and retracted positions along said drive shaft in response to said rotational movement of said drive shaft, said motion conversion mechanism having a first coupler element stationarily disposed at a fixed location offset from one side of said drive shaft and a second coupler element movably disposed at another location offset from another side of said drive shaft angularly displaced from said one side thereof and being coupled to said piston of said hydraulic transmitter such that movement of said motion conversion mechanism between said expanded and retracted positions along said drive shaft in response to rotation of said drive shaft about said rotational axis causes movement of said second coupler element toward and away from said another side of said drive shaft and movement of the remainder of said motion conversion mechanism, except for said fixed first coupler element, and movement of said source of rotary drive motion, said drive shaft and said piston of said hydraulic transmitter connected to said second coupler element therewith along said second linear reciprocatory path extending in a generally orthogonal relationship to said rotational axis of said drive shaft.

9. The machine of claim 8 wherein said source of rotary drive motion is an electric motor having a rotary output shaft, said drive shaft being fixedly attached to and extending outwardly from said rotary output shaft of said electric motor.

10. The machine of claim 8 wherein said drive shaft has left and right portions which are axially displaced from one another and on which are formed respective left and right screw threads.

11. The machine of claim 10 wherein said motion conversion mechanism includes a pair of guidance blocks mounted over said drive shaft and having internal threads complementary to said left and right screw threads on said drive shaft such that said guidance blocks respectively are threadably engaged with said left and right screw threads on said drive shaft.

12. The machine of claim 11 wherein said motion conversion mechanism further includes a left pair of upper and lower guide links which at adjacent one ends thereof are pivotally articulated to said left guidance block and extend therefrom to opposite ends thereof being located remote from one another and pivotally articulated to said fixed first coupler element.

13. The machine of claim 12 wherein said motion conversion mechanism further includes a right pair of upper and lower guide links which at adjacent one ends thereof are pivotally articulated to said right guidance block and extend therefrom to opposite ends thereof being located remote from one another and pivotally articulated to said fixed first coupler element.

14. The machine of claim 13 wherein said left and right screw threads have respective helical configurations which are the reverse of one another such that in response to rotation of said drive shaft in one direction said guidance blocks will translate along said drive shaft away from one another, whereas in response to rotation of said drive shaft in an opposite direction said guidance blocks will translate along said drive shaft toward one another such that said translations of said guidance blocks away from and toward one another causes said left and right pairs of upper and lower links to correspondingly undergo relative movement toward and away from one another and said movable coupler element to undergo movement along said linear reciprocatory path so as to thereby convert said rotary motion of said source thereof and said drive shaft about said rotational axis into said linear reciprocatory motion of said movable coupler element in a direction orthogonal to said rotational axis.

* * * * *